US009233034B2

(12) United States Patent
Storm et al.

(10) Patent No.: US 9,233,034 B2
(45) Date of Patent: Jan. 12, 2016

(54) FOOT SLING FOR A WHEELED CHAIR

(71) Applicant: Storm Showers, LLC, Cookeville, TN (US)

(72) Inventors: David B. Storm, Cookeville, TN (US); Janine Lehman, Owensboro, KY (US)

(73) Assignee: Janine Lehman, Owensboro, KY (US)

( * ) Notice: Subject to any disclaimer, the term of this patent is extended or adjusted under 35 U.S.C. 154(b) by 0 days.

(21) Appl. No.: 14/212,046

(22) Filed: Mar. 14, 2014

(65) Prior Publication Data

US 2014/0265510 A1 Sep. 18, 2014

Related U.S. Application Data

(60) Provisional application No. 61/788,079, filed on Mar. 15, 2013, provisional application No. 61/822,958, filed on May 14, 2013.

(51) Int. Cl.

| | |
|---|---|
| ***A47C 16/02*** | (2006.01) |
| ***A47C 7/52*** | (2006.01) |
| ***A47C 20/02*** | (2006.01) |
| ***A61G 5/12*** | (2006.01) |
| ***A61G 5/10*** | (2006.01) |

(52) U.S. Cl.

CPC ... *A61G 5/10* (2013.01); *A47C 7/52* (2013.01); *A61G 5/12* (2013.01); *A61G 5/1035* (2013.01); *A61G 2203/70* (2013.01)

(58) Field of Classification Search

CPC ..... A61G 5/10; A61G 5/12; A61G 5/1035; A61G 2203/70; A47C 7/52

USPC ..... 297/423.17, 423.18, 423.19, 423.39, 297/423.4, DIG. 4; 280/304.1; 601/27, 28, 601/29, 30, 31, 32

See application file for complete search history.

(56) References Cited

U.S. PATENT DOCUMENTS

| | | | | | |
|---|---|---|---|---|---|
| 3,032,634 | A | * | 5/1962 | Steinel et al. | 297/423.41 X |
| 3,848,922 | A | * | 11/1974 | Blanford | 297/423.39 X |
| 3,863,984 | A | * | 2/1975 | Sickels | 297/423.17 |
| 4,192,546 | A | * | 3/1980 | Smith | 297/423.17 X |
| 4,243,265 | A | * | 1/1981 | Hanik | 297/423.29 X |
| RE30,867 | E | * | 2/1982 | Gaffney | 297/DIG. 4 X |
| 4,421,336 | A | * | 12/1983 | Petrofsky et al. | 297/DIG. 4 X |
| 4,463,985 | A | * | 8/1984 | Kynast | 297/423.29 |
| 4,523,769 | A | * | 6/1985 | Glaser et al. | 297/DIG. 4 X |
| 4,555,121 | A | * | 11/1985 | Lockard et al. | 280/304.1 X |
| 4,930,842 | A | * | 6/1990 | Wilkinson et al. | 297/DIG. 4 X |
| 4,981,305 | A | * | 1/1991 | Lockard et al. | 280/304.1 X |
| 5,052,128 | A | * | 10/1991 | Lonardo | 36/11.5 |
| 5,199,520 | A | * | 4/1993 | Chen | 280/304.1 X |
| 5,209,509 | A | * | 5/1993 | Gay et al. | 280/304.1 |
| D336,452 | S | * | 6/1993 | Holm-Rasmussen | D12/131 |
| 5,290,055 | A | * | 3/1994 | Treat, Jr. | 280/304.1 |
| 5,401,045 | A | * | 3/1995 | Foerster et al. | 280/304.1 X |

(Continued)

*Primary Examiner* — Rodney B White

(74) *Attorney, Agent, or Firm* — Knox Patents; Thomas A. Kulaga

(57) ABSTRACT

Apparatus for a wheelchair foot rest that has two positions: stored and deployed. The foot rest has a base, a heel stop, a toe pocket, and a pair of straps that attach to the side of the base. The ends of the straps attach to extenders connected to the frame of the wheelchair. The extenders support the straps in front of the frame of the wheelchair. With the foot rest in the deployed position the base is suspended from the extenders. The foot rest has a magnetic attraction with a clip attached to the bottom of the seat whereby the foot rest is supported under the seat when in the stored position.

17 Claims, 3 Drawing Sheets

(56) References Cited

U.S. PATENT DOCUMENTS

| | | | | | |
|---|---|---|---|---|---|
| D365,786 | S | * | 1/1996 | Peterson | D12/131 |
| D365,787 | S | * | 1/1996 | Peterson et al. | D12/131 |
| 5,713,591 | A | * | 2/1998 | Zarkhin et al. | 280/304.1 X |
| D397,645 | S | * | 9/1998 | Schaffner | D12/131 |
| D404,693 | S | * | 1/1999 | Schaffner | D12/131 |
| 5,944,131 | A | * | 8/1999 | Schaffner et al. | 280/250.1 X |
| 6,206,119 | B1 | * | 3/2001 | Wu | 180/65.1 |
| 6,352,307 | B1 | * | 3/2002 | Engman | 297/452.4 X |
| 6,422,653 | B1 | * | 7/2002 | Szczepanski et al. | 280/304.1 X |
| 6,872,186 | B2 | * | 3/2005 | Branch et al. | 601/29 X |
| 7,121,572 | B1 | * | 10/2006 | Jaffe et al. | 280/304.1 |
| D652,357 | S | * | 1/2012 | Jurkiewicz et al. | D12/133 |
| D653,176 | S | * | 1/2012 | Jurkiewicz et al. | D12/131 |
| 8,191,913 | B1 | * | 6/2012 | Jessome | 280/304.1 |
| 8,851,214 | B2 | * | 10/2014 | Mirzaie | 180/65.1 |
| 2004/0060748 | A1 | * | 4/2004 | Molnar | 180/65.1 |
| 2004/0084230 | A1 | * | 5/2004 | Grymko et al. | 180/65.1 |
| 2009/0218784 | A1 | * | 9/2009 | Porcheron | 280/250.1 |
| 2011/0089725 | A1 | * | 4/2011 | Shantha et al. | 297/423.4 X |

* cited by examiner

FOOT SLING FOR A WHEELED CHAIR

CROSS-REFERENCE TO RELATED APPLICATIONS

This application claims the benefit of U.S. Provisional Application No. 61/788,079, filed Mar. 15, 2013.

STATEMENT REGARDING FEDERALLY SPONSORED RESEARCH OR DEVELOPMENT

Not Applicable

BACKGROUND

1. Field of Invention

This invention pertains to a foot rest for a wheeled chair. More particularly, this invention pertains to a sling attached to a wheeled chair with the sling movable between a stored position and a deployed position providing support for the occupant's feet.

2. Description of the Related Art

Wheelchairs are useful for transporting persons who are not mobile or who are incapable of walking. Very little has changed in wheelchairs over the years. Generally wheelchairs have two large wheels in the rear, two smaller ones in the front, and a seat positioned between the wheels. Removable, swing-away foot rests are typically attached to the front wheel supports.

For those persons who have some function remaining in their lower legs, wheelchair occupants often shuffle their feet to move the chair forward. In order to accomplish this form of locomotion, the wheelchair foot rests must be either folded up out of the way or removed from the chair. If the rigid foot rests are folded up, they often present a hazard for chair occupants who have limited motor control. For example, the cuff of the occupant's pants leg easily snags on the foot rest and the occupant can be bruised when their legs knock against the foot rests. If the foot rests are removed from the wheelchair, they must be either retrieved or carried with the chair for reinstallation when the occupant tires and can no longer propel the chair by shuffling their feet.

When persons who frequently propel themselves using their feet need to be transported long distances or over uneven terrain, a caregiver will push the chair. To avoid injury to the wheelchair occupant it is necessary that the occupant use the foot rests of the wheelchair. Otherwise the occupant is at risk of having a foot strike the ground and be pulled back as the chair moves forward, resulting in a foot injury. But as noted above, such persons often do not use the foot rests because the persons are used to propelling themselves with their feet and the foot rests are not always available.

BRIEF SUMMARY

According to one embodiment of the present invention, a foot sling for a wheeled chair is provided. The wheeled chair is a wheelchair, a transport chair, or other wheeled chair used to transport persons. Generally, such chairs have rigid foot rests that swing away and may be removable. However, the rigid foot rests are cumbersome and inconvenient for chair occupants who have limited use of their feet and legs. The foot sling is a foot rest movable between a stored position and a deployed position. The foot sling provides a way to transport a person in a wheeled chair with their feet supported when that person is not able to propel themselves with their feet. There are times when persons bound to a wheel chair grow tired of using their feet to propel themselves. If the wheeled chair does not have foot rests, the foot sling provides an easily accessible way for the chair occupant to rest their feet will being transported.

The foot sling includes a platform and a pair of straps that are attachable to the frame of a wheeled chair. The platform includes a base, a toe pocket, and a heel stop. In various embodiments the base has a stiffness ranging from semi-rigid to rigid. The toe pocket extends the full width of the front of the base. The toe pocket is sized to accommodate the toe part of the patient's feet regardless of being barefoot or wearing footwear. The heel stop is a barrier extending across the width of the base at the rear of the base. In one embodiment, the heel stop is a sheet that extends substantially perpendicular to the base.

Each of the straps attach to the base with a strap support. The strap support has a wing shape that distributes the load from the strap across a substantial portion of the side of the base. In one embodiment, the straps have a releasable connector that permits a portion of the foot sling to be removed from the chair. The distal ends of the straps have a loop or other mechanism that attaches to a member of the chair. Most wheeled chairs have vertical members proximate the front wheels. For such chairs, that vertical member is an ideal place to position the loop at the end of the straps. In other embodiments extenders are attached to the chair on either side of the seat and the end of the straps attach to the extenders. The extenders ensure that the foot sling is positioned in front of the seat such that the occupant can readily rest their feet in the foot sling. In one such embodiment the extenders are telescoping devices that retract when the sling is stored or removed from the chair. In another such embodiment the extenders are plates each with a multiposition opening that receives the end of the strap.

In one embodiment, the foot sling includes an attachment mechanism to support the foot sling in a stored position on the chair. In one such embodiment the attachment mechanism is a magnetic member configured to attach to the chair. The magnetic member of the attachment mechanism is magnetically attracted to another magnetic member attached to the platform such that the platform is supported by the attachment mechanism when the platform is in the stored position. In one such embodiment the attachment mechanism includes a pin that attaches to the bottom of the seat of the chair. The attachment mechanism also includes a magnet attached to the heel stop. The magnet is attracted either to the pin or to the metal frame of the chair when the foot sling is positioned under the seat by swinging the foot sling to the rear of the chair until the magnet contacts the other magnetic member. In another such embodiment, the attachment mechanism includes a hook and loop fastening system. One half of the hook and loop fastening system is attached to the chair and the other half is attached to the foot sling. As with the magnet, the foot sling is swung backwards. When contact is made with the chair and the two halves of the hook and loop fastening system engage, the foot sling is supported in the stored position.

BRIEF DESCRIPTION OF THE SEVERAL VIEWS OF THE DRAWINGS

The above-mentioned features will become more clearly understood from the following detailed description read together with the drawings in which.

DETAILED DESCRIPTION

Apparatus for wheeled chairs are disclosed. A foot sling supports the feet of a wheeled chair occupant. The foot sling is generally indicated as 100, with particular embodiments and variations shown in the figures and described below having an alphabetic suffix, for example, 100-A, 100-B.

Figure 1:
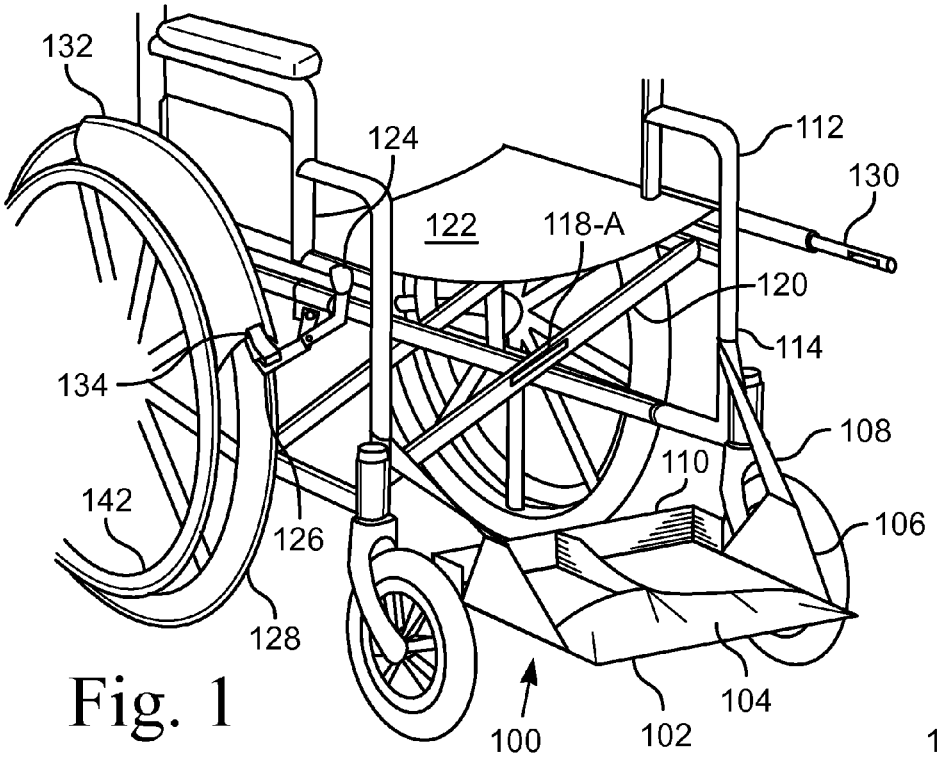
FIG. 1 is a perspective view of a foot sling attached to a wheeled chair.

FIG. 1 illustrates a perspective view of a foot sling 100 attached to a wheeled chair 112. The wheeled chair 112 is a wheelchair, a transport chair, or other wheeled chair used to provide mobility for persons. Generally, such chairs have rigid foot rests that swing away. The foot rests are also often removable. However, the rigid foot rests are often cumbersome and inconvenient for chair occupants who have limited use of their feet and legs.

The illustrated foot sling 100 includes a platform having a base 102, a toe pocket 104, a heel stop 110, and a pair of strap supports 106 each with a strap 108. The foot sling 100 is attached to the chair 112 with the straps 108. The illustrated chair 112 has a pair of vertical members 114, each positioned proximate a front wheel of the chair 112. The distal end of each strap 108 is looped around the vertical member 114. The lengths of the straps 108 are adjusted to support the base 102 at a desired height for the chair's occupant to rest his feet thereupon.

FIG. 1 shows a single extender 130 protruding from the frame 120 of the chair 112. The extender 130 is shown for illustrative purposes and is further described with the discussion of FIGS. 7-9. In use, a pair of extenders 130 would be attached to the chair 112, one extender 130 on each side of the seat 122. The straps 108 would attach to the distal end of the extenders 130 instead of the vertical members 114.

FIG. 1 shows the foot sling 100 in the deployed position. The deployed position has the base 102 substantially parallel to and above the floor such that the sling 100 receives and supports the feet of the occupant of the chair 112. The foot sling 100 has a stored position in which the base 102 is swung towards the rear of the chair 112 and secured to the chair 112 under the seat 122. In one embodiment, one embodiment of a chair mounted attachment mechanism 118-A is attached to the frame 120 of the chair 112 at a location where the foot sling 100 engages the frame 120 of the chair 112 when the foot sling 100 is swung back.

A fender 132 floats over a portion of the tire 128 of the chair 122. The front of each floating fender 132 attaches to the brake lever 126 of the hand brake 124 with a clip 134. The rear of the floating fender 132 is retained over the tire 128.

Figure 2:
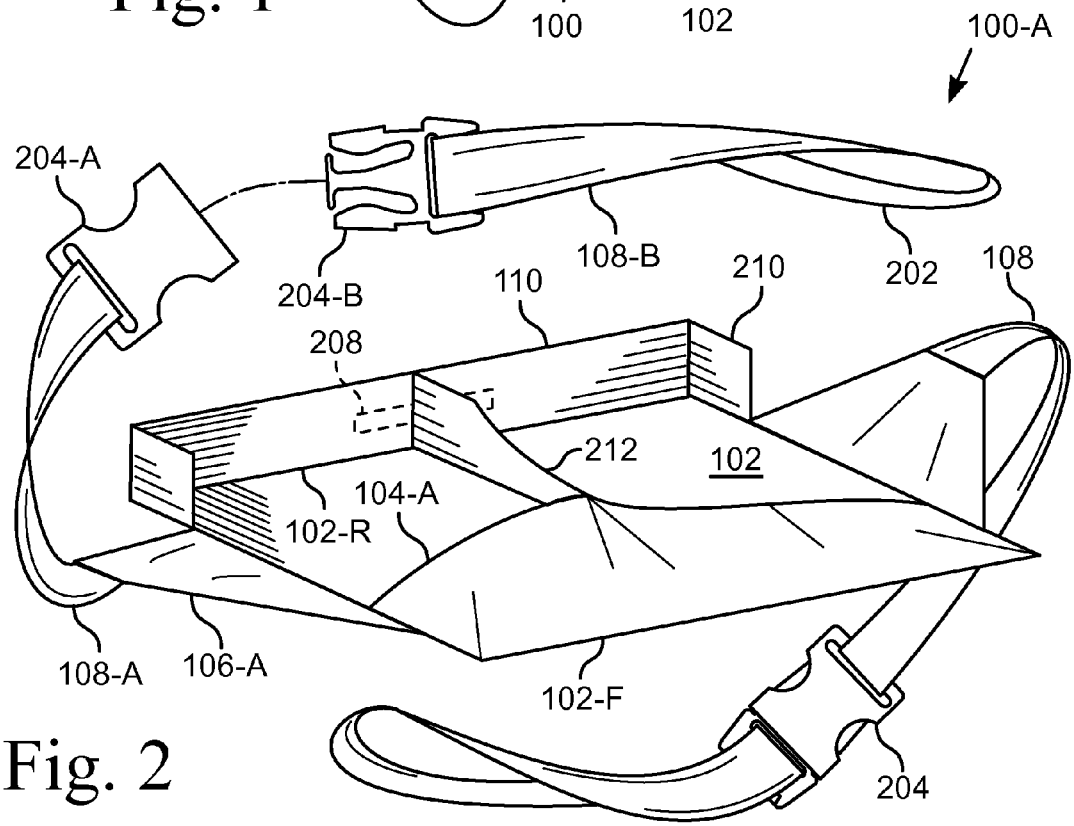
FIG. 2 is a perspective view of one embodiment of a foot sling.

FIG. 2 illustrates a perspective view of one embodiment of a foot sling 100-A. The illustrated embodiment of the foot sling 100-A includes a base 102, a flexible toe pocket 104-A, a foot divider 212, a pair of strap supports 106-A, a pair of straps 108, and a back rest 110.

The base 102 is a flat, planar member that is sufficiently rigid to support the feet of an occupant sitting in the chair 112. In one embodiment the base 102 includes a sheet of resilient plastic that is enclosed in a covering. In another embodiment the base 102 includes a sheet of ¼ inch thick anti-microbial stiff foam enclosed in a covering. In yet another embodiment the base 102 includes a stiff material that remains substantially planar when the foot sling 100 is in use. In one such embodiment (shown in FIG. 3) the base 102 includes a stiff batten 308 that fits into a pocket in the base 102. The stiff material and the batten prevent the base 102 from sagging significantly when the occupant is resting their feet on the base 102. The covering is waterproof to allow for cleaning.

The toe pocket 104-A is attached to the front of the base 102. In the illustrated embodiment the toe pocket 104-A is a flexible material with an opening sized to receive the toe portion of the feet of the chair's occupant, whether wearing socks, shoes, slippers, or being barefoot.

The foot divider 212 is attached to the heel stop 110 and the base 102 and extends into the toe pocket 104-A. The foot divider 212 is a stiff material that is perpendicular to the base 102 and serves to position the chair occupant's feet on each side of the base 102 and preventing the occupant from placing both feet on one side of the base 102. In one embodiment the foot divider 212 is hingedly connected to the base 102 so that the foot divider 212 folds down flat when not needed. In such an embodiment the rear portion of the foot divider 212 either attaches to the heel stop 110 or has a fold out member that supports the foot divider 212 vertically relative to the base 102. In one embodiment the foot divider 212 extends into the toe pocket 104-A and the foot divider 212 supports the upper sheet 404 above the base 102, thereby aiding the placement of the toes of the occupant into the toe pocket 104-A.

The heel stop or back rest 110 is a member attached to the rear of the base 102. In the illustrated embodiment the heel stop 110 includes two wings 210 that extend partially along the sides of the base 102 toward the front. The wings 210, in combination with the toe pocket 104, serve to contain the occupant's feet on the foot sling 100-A. In one embodiment, the heel stop 110 includes a rigid member, such as a sheet of plastic, that minimizes the side to side flexing of the rear of the base 102. In another embodiment, the heel stop 110 includes a sheet of ⅛ inch thick anti-microbial stiff foam enclosed in a covering. The covering is waterproof to allow for cleaning.

One embodiment of a sling mounted attachment mechanism secures the base 102 of the foot sling 100 under the seat 122 when the foot sling 100 is in the stored position. The attachment mechanism is released to restore the foot sling 100 to the deployed position. In one embodiment, the attachment mechanism is a magnet 208 attached to the rear of the heel stop 110. The magnet 208 engages a metal portion of the chair frame 120 to hold the base 102 of the foot sling 100-A under the seat 122. In another embodiment, the magnet 208 is attached to the bottom of the base 102.

In another embodiment, a sling mounted attachment mechanism 208 is one half of a hook and loop fastening system attached to the rear of the heel stop 110 or under the base 102. The other half 118-A of the hook and loop fastening system is attached to the frame 120 of the chair 112. In various such embodiments, the chair mounted attachment mechanism 118-A attached to the chair frame 120 is attached with an adhesive or is wrapped around a member of the frame 120. When the base 102 is swung back, the two mating parts of the attachment mechanism 118, 208 engage and hold the base 102 in the stored position.

The strap supports 106-A are flaps or wings attached to the sides of the base 102. The strap supports 106-A are a flexible material having a trapezoidal shape. The side that is the larger base provides support across a substantial portion of the base 102 between the front and rear of the base 102. The smaller base of the strap support 106-A attaches to a distal end of the strap 108-A. In this way the load from the base 102 is transferred to the narrow strap 108. In the illustrated embodiment, the wide side of the strap supports 106-A each have a length at least one-half the distance between the front 102-F and the rear 102-R of the base 102.

Each strap 108 in the illustrated embodiment has two sections 108-A, 108-B. One section 108-A has a distal end attached to a strap support 106. The other end of the strap 108-A is attached to one half 204-A of a buckle. The other section 108-B is attached to the other half 204-B of the buckle. In the illustrated embodiment, the buckle 201-A, 204-B is a conventional side release buckle. Those skilled in the art will recognize that other types of buckles and fasteners can be used without departing from the spirit and scope of the present invention.

The distal end of the other section 108-B of the strap 108 has a loop 202 for engaging a member 114 of the chair frame 120. During use, the other section 108-B is secured to the chair 102 and remains with the chair 102 when the base 102 portion of the foot sling 100 is removed. In one embodiment, the loop 202 is formed from the two ends of the strap section 108-B attached to the buckle half 204-B.

Figure 3:
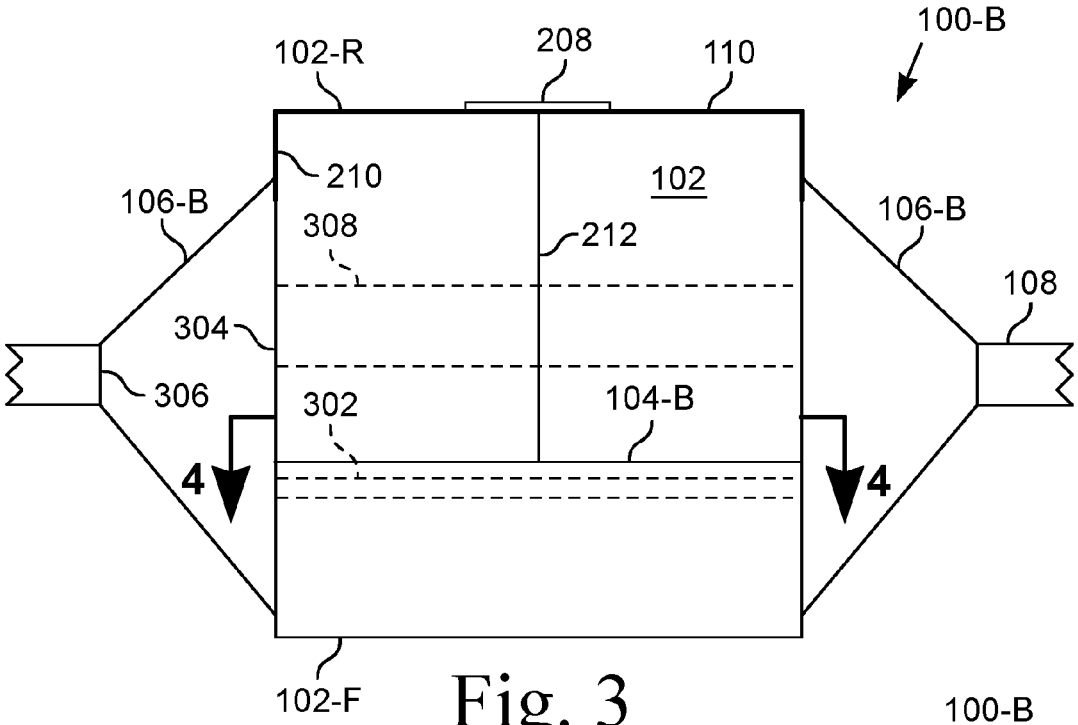
FIG. 3 is a top view of another embodiment of a foot sling.
Figure 4:
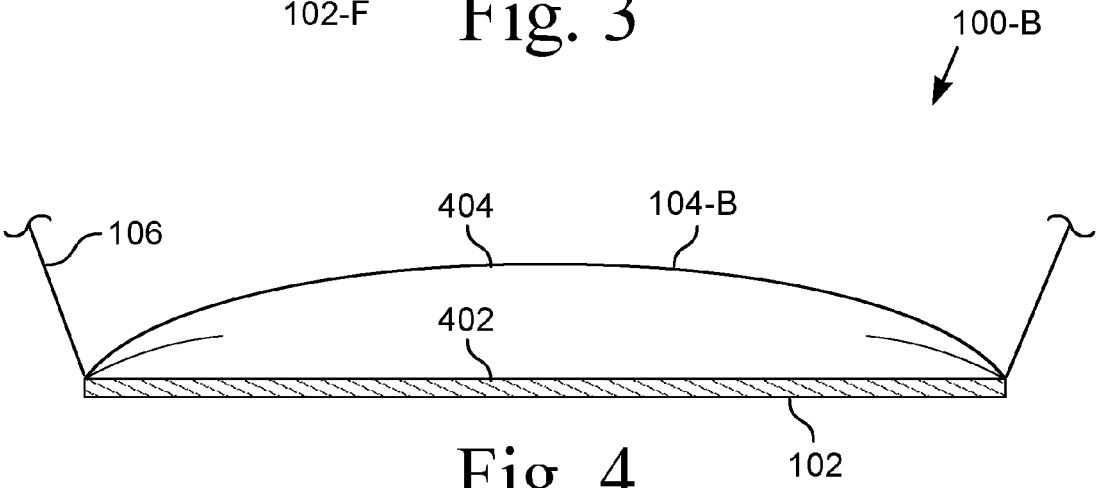
FIG. 4 is a cross-sectional view of the foot sling shown in FIG. 3.

FIG. 3 illustrates a top view of another embodiment of a foot sling 100-B. FIG. 4 illustrates a cross-sectional view of the foot sling 100-B shown in FIG. 3. In the illustrated embodiment, the toe pocket 104-B includes a toe pocket stiffener 302. The toe pocket stiffener 302 is a batten that keeps the mouth of the toe pocket 104-B open. In one such embodiment the toe pocket stiffener 302 fits into the upper sheet 404 like a batten fits into a sailboat's sail, that is, the batten 302 is biased in the pocket so that the material is made taut by the batten 302. The toe pocket 104-B has an upper sheet 404 that is kept above and separated from the top surface 402 of the base 102 by the toe pocket stiffener 302, thereby enabling the occupant to slide his toes into the toe pocket 104-B.

FIG. 3 also illustrates a base stiffener or base batten 308 that is positioned from side to side in the base 102. The base stiffener 308 is a rigid material that prevents the base 102 from sagging too much when the occupant has his feet placed on the base 102. In one embodiment the base stiffener 308 is in a base pocket formed in the base 102. In one such embodiment the base stiffener 308 fits into the base pocket like a batten fits into a sailboat's sail.

FIG. 3 shows the strap supports 106-B positioned in the same plane as the base 102. Each strap support 106-B has a wide side 304 and a narrower side 306. The wide side 304 attaches to the side of the base 102 such that the narrower side 306 is centered between the front 102-F and the rear 102-R of the base 102. In this way the base 102 is balanced when supported by the straps 108. In the illustrated embodiment, the wide side 304 of the strap support 106-B has a length a significant portion of the distance between the front 102-F and the rear 102-R of the base 102.

Figure 5:
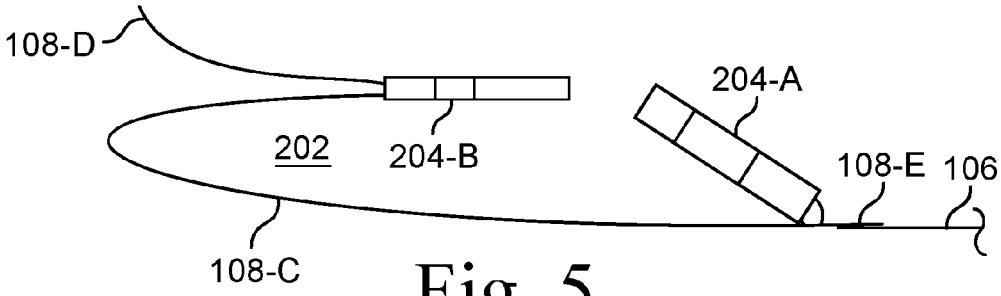
FIG. 5 is a side view of another embodiment of a strap.

FIG. 5 illustrates a side view of another embodiment of the strap 108-C. The strap 108-C is a single length of webbing. One end 108-E of the strap 108-C is attached to the strap support 108, such as by sewing. Adjacent the attached end 108-E is a small loop in the strap 108-C that engages a buckle half 204-A. The distal end 108-D of the strap 108-C engages the mating buckle half 204-B. With the two buckle halves 204-A, 204-B mated, a loop 202 is formed that is suitable for enclosing a member 114 of the chair frame 120. The size of the loop 202, and the distance the strap support 106 is from the member 114, is adjusted by moving the distal end 108-D of the strap 108-C relative to the buckle half 204-B. The foot sling 100 is removed from the chair 102 by unbuckling the halves 204-A, 204-B.

Figure 6:
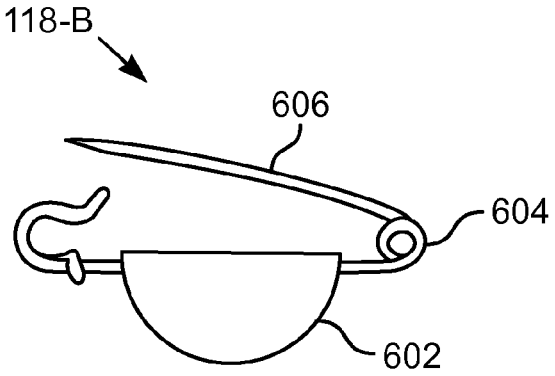
FIG. 6 is a plan view of another embodiment of a chair mounted attachment mechanism.

FIG. 6 illustrates a plan view of another embodiment of chair mounted attachment mechanism 118-B. The attachment mechanism 118-B includes a latching pin 604, for example a safety pin, with an attached metal member 602. In the illustrated embodiment, the metal member 602 is circular member that is folded over and held captive on the latching pin 604. The metal member 602 is magnetically attracted by the magnet 208. The latching pin 604 has a sharp member 606 suitable for attaching the attachment member 118-B to the underside of the seat 122. With the chair mounted attachment mechanism 118-B attached under the seat 122, the magnet 208 at the back of the heel stop 110 positions the foot sling 100 sufficiently far back from the front edge of the seat 122 to keep the foot sling 100 out of the way of the feet and legs of the chair occupant.

Figure 9:
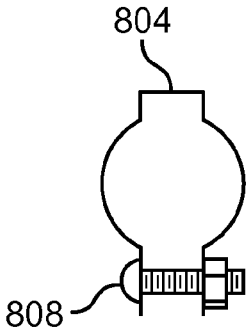
FIG. 9 is a side view of one embodiment of a clamp for the extender.
Figure 7:
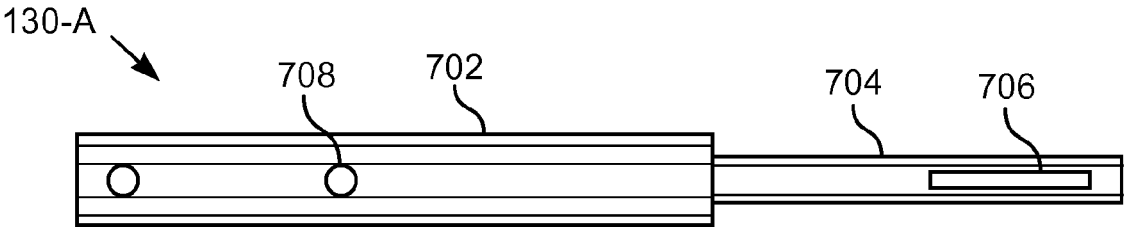
FIG. 7 is a side view of one embodiment of an extender.
Figure 8:
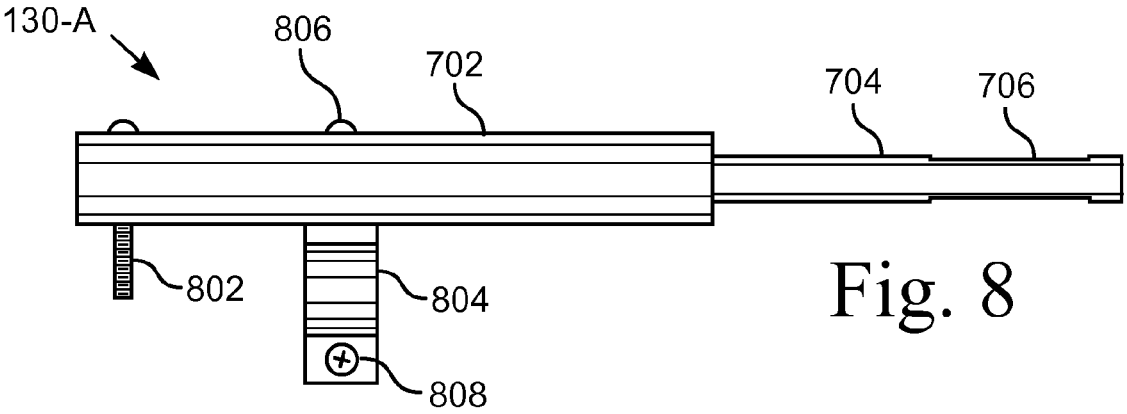
FIG. 8 is a top view of the extender shown in FIG. 7.

FIG. 7 illustrates a side view of one embodiment of an extender 130-A. FIG. 8 illustrates a top view of the extender 130-A shown in FIG. 7. FIG. 9 illustrates a side view of one embodiment of a clamp 804 for the extender 130-A. A pair of extenders 130-A attach to the frame 120 of the wheeled chair 112. The extenders 130-A allow the foot sling 100 to be positioned forward of the seat 122 to accommodate tall or long legged occupants of the wheeled chair 112. FIG. 1 illustrates one extender 130 attached to the chair frame 120 using the member that supports the seat 122.

The illustrated extender 130-A telescopes. It includes a stationary member 702 and a telescoping or moving member 704, both of which can be cylindrical as illustrated or tubular. The stationary member 702 includes a pair of through-holes 708 for attaching the stationary member 708 to the frame 120. FIG. 8 shows two embodiments for attaching the stationary member 708 to the chair 112. One embodiment has fasteners 802 that engage openings in the chair frame 120. The fasteners 802 engage a nut positioned on the opposite side of the chair frame 120. In another embodiment, a pair of clamps 804 are attached to the stationary member 702 with fasteners 806. The clamps 804 fit around a member of the frame 120 and tightened with fasteners 808.

The extender 130-A also includes a telescoping member 704 that slides relative to the stationary member 702. The telescoping member 704 includes a stop or detent mechanism that holds the telescoping member 704 at a specified extension and prevents the telescoping member 704 from being removed from the stationary member 702. The telescoping member 704 includes a through-slot 706 that receives a strap 108. The strap 108-B engages the slot 706, thereby suspending the base 102 under the distal end of the telescoping member 704, which places the base 102 forward of the vertical members 114 of the chair frame 120.

In another embodiment of the extenders 130, the moving member 704, instead of telescoping, is hingedly connected to the stationary member 702. The moving member 704 folds upward and back over the stationary member 702. In this way the moving member 704 allows the straps 108 to be supported in an extended position while also allowing the projection of the extenders 130 to be minimized by folding the moving member 704 over the stationary member 702.

Figure 10:
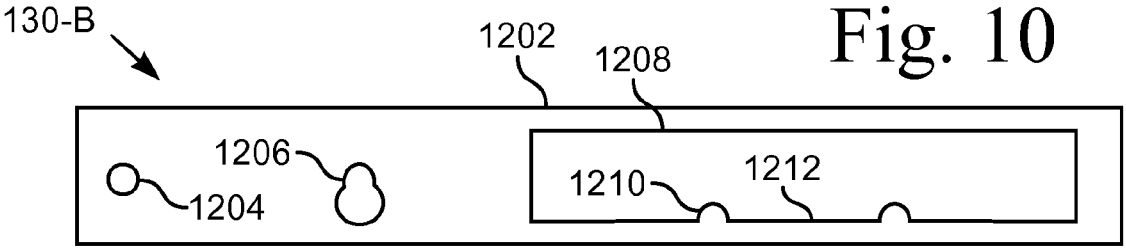
FIG. 10 is a side view of another embodiment of an extender.

FIG. 10 illustrates a side view of another embodiment of an extender 130-B. The illustrated embodiment of the extender 130-B is a flat plate 1202 with two mounting holes 1204, 1206 and one opening 1208 to receive the loop 202 of the strap 108. One mounting hole 1204 is configured to receive a fastener for attaching the extender 130-B to a support member of the chair 112. The second mounting hole 1206 is configured with a larger open end to receive a fastener end protruding from the support member of the chair 112. With the fastener loosely engaging the first hole 1204, the extender 130-B is manipulated so the second fastener engages the larger open end of the second mounting hole 1206. The extender 130-B is then rotated so that the second fastener engages the smaller open end of the second mounting hole 1206, thereby securing the extender 130-B to the chair 112. The weight of the foot sling 100 applied by the strap 108 holds the extender 130-B in place and keeps the second fastener engaging the smaller open end of the second mounting hole 1206. When the foot sling 100 is removed from the wheelchair 112, the extender 130-B is manipulated to release the second fastener from the second mounting hole 1206 and the extender 130-B is allowed to hang down from the fastener in the first mounting hole 1204, thereby ensuring that the unused extender 130-B does not present a hazard.

The extender 130-B includes an opening 1208 with three positions 1212 for positioning the strap 108. The positions 1212 are defined by the sides of the opening 1208 and the protrusions 1210 extending upward from the bottom of the opening 1208. Each position 1212 is slightly wider than the width of the strap 108 such that the loop end 202 of the strap 108 is held in place by the weight of the foot sling 100.

The foot sling 100 has two operational positions or configurations. One position is the stored position and the other is the deployed position. With the foot sling 100 attached to the chair 112, the foot sling 100 is pushed back under the seat 122 to the stored position. In the stored position, the magnet 208 engages the chair mounted attachment mechanism 118-B. When desired to be used the foot sling 100 is moved to the deployed position. The base 102 is pulled away from the chair mounted attachment mechanism 118-B and allowed to hang supported by the straps 108. The occupant of the chair 112 rests their feet on the base 102. Depending upon the stiffness of the base 102 and the heel stop 110, the base 102 flexes from the weight of the occupant's feet. The height of the base 102 above the floor is adjusted with the straps 108 to ensure that the bottom of the base 102 does not drag on the floor when it is supporting the occupant's feet.

The toe pocket 104 is available for when the chair's occupant needs to have their foot position controlled. By placing the toes of the occupant's feet inside the toe pocket 104, the feet are ensured to remain on the base 102 as the occupant is being transported in the chair 112. For those chair occupants with motor control of their legs and feet the toe pocket 104 does not need to be used.

The foot sling 100 includes various functions. The function of supporting the feet of the chair's occupant is implemented, in one embodiment, by the platform that includes the base 102 attached to the chair 102 with the straps 108.

The function of keeping the feet captive in the foot sling 100 is implemented, in one embodiment, by the heel stop 110 and the toe pocket 104. The heel stop 110 keeps the feet from moving backwards off the base 102. The toe pocket 104 keeps the feet from moving forwards off the base 102.

The function of storing the foot sling 100 out of the way is implemented by the attachment mechanism. In one embodiment, the attachment mechanism 118-B includes a latching pin 604 configured to attach to the chair 112 and a magnetic member 208. The latching pin 604 and magnetic member 208 are magnetically attracted to each other such that, when in contact, the foot sling 100 is supported in the stored position. In another embodiment the attachment mechanism includes a magnet 208 attached to the foot sling 100. The magnet 208 magnetically attaches to a member 120 of the chair. In another embodiment, the attachment mechanism includes a hook and loop fastener 118-A, 208. One half 118 of the hook and loop fastener is attached to the frame 120 of the chair 102 and the other half 208 is attached to the heel stop 110 or the bottom of the base 102.

The function of attaching the foot sling 100 to the chair 102 is implemented, in one embodiment, by the pair of straps 108. Each strap 108 has a loop 202 that engages a member 114 of the chair 112. In various embodiments the loop 202 is reclosable such that the end of the strap 108 can be positioned around a member 114 of the chair frame 120 and then closed to secure the strap 108 to the frame 120. In one embodiment, each strap 108-C is a single length of webbing with one buckle half 204-A attached medially to the strap 108-C and the other buckle half 204-B attached near the distal end 108-D of the strap 108-C. The distance the foot sling 100 is from the chair 102 is adjustable by moving the distal end of the strap 108 relative to the buckle half 204-B.

The function of providing an opening in the toe pocket 104-B is implemented, in one embodiment, by a stiffener 302 proximate the opening of the toe pocket 104-B. The stiffener 302 elevates the upper sheet 404 of the toe pocket 104-B from the top surface 402 of the base 102, thereby allowing unimpeded entry of the toes of the chair occupant. In another embodiment the function of providing an opening in the toe pocket 104-B is implemented by the divider 212 that extends into the toe pocket 104 and supports the upper sheet 404 above the top surface 402.

The function of positioning the base 102 of the foot sling 100 forward of the seat 122 is implemented by the extenders 130 attached to the chair frame 120 and supporting the straps 108 forward of the vertical members 114 of the chair 112. In one such embodiment the extenders 130-A are telescopic, such as illustrated in FIGS. 7-9. In another such embodiment the extenders 130-B are flat plates 1202 with an opening 1208 configured to receive the strap 108, such as illustrated in FIG. 10.

From the foregoing description, it will be recognized by those skilled in the art that a foot sling 100 for a wheelchair 102 has been provided. The foot sling 100 provides support for the feet of the occupant of the wheelchair when needed and the sling 100 is readily moved out of the way when not needed.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. An apparatus for supporting the feet of an occupant of a chair with the feet above a floor level, said apparatus comprising:

a base having a front, a rear, and two sides, said base having a top surface;

a toe pocket attached to said front of said base, said toe pocket extending upwards from said top surface, said toe pocket having an opening facing said rear of said base;

a heel stop extending substantially perpendicular from said top surface at said rear of said base; and a pair of straps each extending from each one of said two sides of said base, said pair of straps configured to attach to the chair such that said base is suspended above the floor;

whereby said base accommodates the feet of the occupant while the occupant is seated in the chair; and wherein said pair of straps are attached to said base with a pair of strap supports, each one of said strap supports having a first support side and a second support side opposite said first support side, each one of said first support sides attached to one of said two sides of said base, said first support side having a length at least one-half a distance between said front and rear of said base, and said second support side being substantially centered between said front and rear of said base.

2. The apparatus of claim 1 wherein each one of said pair of straps have a buckle with each one of said pair of straps having a loop formed with said buckle.

3. The apparatus of claim 1 wherein said pair of straps each have a buckle separating said each one of said pair of straps into two sections, and each said buckle releasably connecting said two sections.

4. The apparatus of claim 1 wherein each one of said pair of straps include a loop at an end distal to said two sides of said base, each said loop configured to attach to the chair.

5. The apparatus of claim 1 further including a stiffener positioned proximate said opening of said toe pocket, and said stiffener configured to keep an upper wall of said toe pocket above said top surface of said base.

6. The apparatus of claim 1 wherein said base includes a stiffener that maintains said base in a substantially planar configuration with said apparatus in a deployed position wherein said base is suspended from the chair.

7. The apparatus of claim 1 further including a pair of extensions configured to attach to the chair, each one of said pair of extensions receiving a distal end of a corresponding one of said pair of straps.

8. An apparatus for supporting the feet of an occupant of a chair with the feet above a floor level, said apparatus comprising:

a platform having a base and a back rest, said base having a pair of sides in opposing relationship;

a pair of straps of a flexible material, each one of said straps having a proximal end attached to one of two sides of said base;

a pair of attachment members each configured to attach to a member of the chair; and a distal end of each one of said pair of straps attached to a corresponding one of said pair of attachment members, such that said platform is operable to transition between a stored position and an open position when said pair of attachment members are attached to the chair; and a pair of strap supports in which each one of said strap supports is attached to a corresponding one of said pair of sides, said pair of straps attached to a corresponding one of said pair of strap supports, each one of said strap supports having a first support side and a second support side opposite said first support side, said first support side having a length at least one-half a distance between said front and rear of said base, and said second support side being substantially centered between said front and rear of said base.

9. The apparatus of claim 8 wherein said platform has a magnetic attraction for a clip configured to be attached to the chair, and when said clip is attached to said chair said platform is suspended from said clip when said platform is in said stored position.

10. The apparatus of claim 9 wherein said clip attaches to a bottom of a seat of the chair.

11. The apparatus of claim 8 further including a toe pocket on said base, said toe pocket proximate a front of said base.

12. The apparatus of claim 11 wherein said toe pocket has an opening that is supported above said base by a stiffener.

13. The apparatus of claim 8 wherein said platform includes a stiffener that maintains said base in a substantially planar configuration with said platform in said deployed position.

14. An apparatus for supporting the feet of an occupant of a chair with the feet above a floor level, said apparatus comprising:

a platform having a base and a back rest, said base having a pair of sides in opposing relationship;

a pair of straps of a flexible material, each one of said straps having a proximal end attached to one of two sides of said base; and a pair of attachment members each configured to attach to a member of the chair, a distal end of each one of said pair of straps attached to a corresponding one of said pair of attachment members wherein when said pair of attachment members are attached to the chair said platform is movable between a stored position and a deployed position;

a pair of strap supports in which each one of said strap supports is attached to a corresponding one of said pair of sides, said pair of straps attached to a corresponding one of said pair of strap supports, each one of said strap supports having a first support side and a second support side opposite said first support side, said first support side having a length at least one-half a distance between said front and rear of said base, and said second support side being substantially centered between said front and rear of said base;

a first magnetic member attached to said platform; and a second magnetic member configured to attach to the chair, said first magnetic member and said second magnetic member having a magnetic attraction therebetween such that said second magnetic member supports said platform in said stored position when said first and second magnetic members are engaged.

15. The apparatus of claim 14 wherein said second magnetic member includes a pin configured to engage a bottom of a seat of the chair.

16. The apparatus of claim 14 further including a toe pocket opposite said back rest on a front of said base, said toe pocket configured to receive the toes of the occupant of the chair when said platform is in a deployed position.

17. The apparatus of claim 14 wherein said platform is movable between said stored position and a deployed position, said platform suspended in front of the chair below a seat of the chair when said platform is in said deployed position.

* * * * *